US005722436A

United States Patent [19]

Vandromme et al.

[11] Patent Number: 5,722,436

[45] Date of Patent: Mar. 3, 1998

[54] APPLICATOR ASSEMBLY FOR A COSMETIC PRODUCT, SUCH AS MASCARA, AND CORRESPONDING APPLICATOR

[75] Inventors: Michel Vandromme, Le Plessis-Brion; Charles Pileur, Noyon, both of France

[73] Assignee: Sanofi, Paris, France

[21] Appl. No.: 633,780

[22] PCT Filed: Sep. 11, 1995

[86] PCT No.: PCT/FR95/01164

§ 371 Date: Jul. 12, 1996

§ 102(e) Date: Jul. 12, 1996

[87] PCT Pub. No.: WO96/08180

PCT Pub. Date: Mar. 21, 1996

[30] Foreign Application Priority Data

Sep. 12, 1994 [FR] France ..... 94 10866

[51] Int. Cl.[6] ..... A45D 40/26

[52] U.S. Cl. ..... 132/218; 132/317; 132/313; 132/320; 401/129

[58] Field of Search ..... 132/218, 317, 132/318, 313, 320; 401/128, 129, 122, 126, 127

[56] References Cited

U.S. PATENT DOCUMENTS

| | | | |
|---|---|---|---|
| 3,130,735 | 4/1964 | Clark | 401/128 |
| 3,469,928 | 9/1969 | Widegren | 401/128 |
| 3,471,244 | 10/1969 | Melocchi . | |
| 3,998,235 | 12/1976 | Kingsford | 410/128 |
| 3,998,325 | 12/1976 | Kingsford . | |
| 4,403,624 | 9/1983 | Montgomery | 401/129 |
| 4,446,880 | 5/1984 | Gueret et al. . | |
| 4,498,490 | 2/1985 | Seidler . | |
| 4,545,393 | 10/1985 | Gueret et al. . | |
| 4,586,520 | 5/1986 | Brittain | 132/320 |
| 5,121,763 | 6/1992 | Kingsford | 132/217 |

FOREIGN PATENT DOCUMENTS

| | | |
|---|---|---|
| 002301 | 6/1979 | European Pat. Off. . |
| 161980 | 11/1985 | European Pat. Off. . |
| 610107 | 8/1994 | European Pat. Off. . |
| 2390917 | 12/1978 | France . |

*Primary Examiner*—Gene Mancene
*Assistant Examiner*—Pedro Philogene
*Attorney, Agent, or Firm*—Rothwell, Figg, Ernst & Kurz

[57] ABSTRACT

An assembly for the storage and application of a cosmetic product. The assembly includes: a body which is provided with an opening and includes a reservoir capable of containing the product; an applicator capable of coming into contact with the product and of being charged with a given amount thereof and retaining structure for ridding the applicator of excess product. The applicator has a rod carrying a product-application structure which is to apply the product, the structure for retaining the product being connected to the body and/or to the rod. The field of use of the invention is that of cosmetics, more especially that of "mascaras" to be applied to eyelashes.

22 Claims, 3 Drawing Sheets

APPLICATOR ASSEMBLY FOR A COSMETIC PRODUCT, SUCH AS MASCARA, AND CORRESPONDING APPLICATOR

BACKGROUND OF THE INVENTION

1. Field of the Invention

The invention relates to an applicator and an assembly for the storage and application of a cosmetic product, especially "mascara" to be deposited on the eyelashes, or even another product such as a pasty or more or less viscous lipstick.

2. Description of the Related Art

U.S. Pat. No. 3,998,235 discloses an "adjustable" applicator comprising:

at least one axial rod;

a structure for the application of the product, which structure is carried by the rod and comprises adjacent surfaces for the application of the product;

manoeuvring means for adjusting the axial spacing between the application surfaces in order to optimise the action of the applicator and the amount of product to be applied.

In spite of that, there are still problems, especially concerning the clogging of the applicator, charging with an amount of product which is sometimes inappropriate (especially too great), or drying and/or loss of quality of the product. In particular, there is a problem concerning the manner of manufacturing the applicator in such a manner as to obtain effective and reliable adjustment of the application surfaces.

SUMMARY OF THE INVENTION

With a particular view to solving the last problem, the invention proposes to manufacture the application structure of the applicator in such a manner that it comprises:

at least one first member defining the surfaces for applying the product and, connected thereto, at least one second, resiliently deformable member for adjusting the axial spacing of the surfaces from one another, under the action of the manoeuvring means.

Thus, the application structure of the invention comprises two distinct elements (or assemblies of elements) which cooperate with one another although they are capable of fulfilling separate functions: on the one hand, a support structure for the surfaces for applying the product and, on the other hand, one or more member(s) of resiliently deformable material for adjusting the axial distance between two successive application surfaces of the support.

Advantageously, according to another, complementary feature of the invention:

the first member comprises a filamentary structure to which bristles for the application of the product are attached;

the second member comprises a tube which is resiliently deformable axially and on which the filamentary structure is arranged;

and the rod comprises two parts which are movable with respect to one another and are formed by a first axial rod, about a first portion of which is arranged a second, hollow, axial rod and about a second portion of which is arranged the resiliently deformable tube which is interposed and retained for its axial adjustment between the second, hollow, rod and a bulging portion arranged at a free end of the first rod.

In order to optimise efficiency requirements in respect of adjustment and manufacture, it is also recommendable for the adjusting tube to comprise at least one peripheral groove in which the filamentary structure is arranged, for its axial adjustment.

In addition, in order to disassociate as far as possible the functions of "application support" (performed by the first member) and of "adjustment of the axial spacing between the application surfaces" (performed by the second member), a likewise complementary feature of the invention provides that the first member may be substantially devoid of spring capacity.

Another problem which the invention is intended to solve concerns the cleaning of the rod and the drying of the applicator.

The prior art, especially FR-A-2 390 917, EP-A-161 980 or EP-A-0 002 301, discloses assemblies which comprise, in addition to an applicator, a body provided with an opening and including a reservoir capable of containing the product to be applied, as well as product-retaining means, which are connected to the body or to the rod of the applicator, for ridding the latter of excess product. The above-mentioned documents even propose different solutions for obtaining "variable drying" of the applicator.

There are, however, still imperfections in the performance or the efficiency of these solutions which the invention intends to solve by proposing an assembly in which the means for retaining excess product comprise a device for drying the application structure and for cleaning the rod, the device being arranged and retained inside the body and comprising a first and a second portion for retaining the product, which portions are spaced axially from one another, and having an internal passage capable of receiving the applicator in a sliding manner.

The device in question may be slidably mounted in the body and may have a variable diameter.

BRIEF DESCRIPTION OF THE DRAWINGS

Other features and advantages of the invention will be appreciated more clearly from the following description which is given with reference to the appended drawings, in which.

DETAILED DESCRIPTION OF THE PREFERRED EMBODIMENTS

The following is limited to the single example of "mascara", although the assembly of the invention can be used for other products. The term "mascara" is to be interpreted as covering a more or less viscous or pasty make-up product for the eyelashes or the eyebrows.

Figure 1:
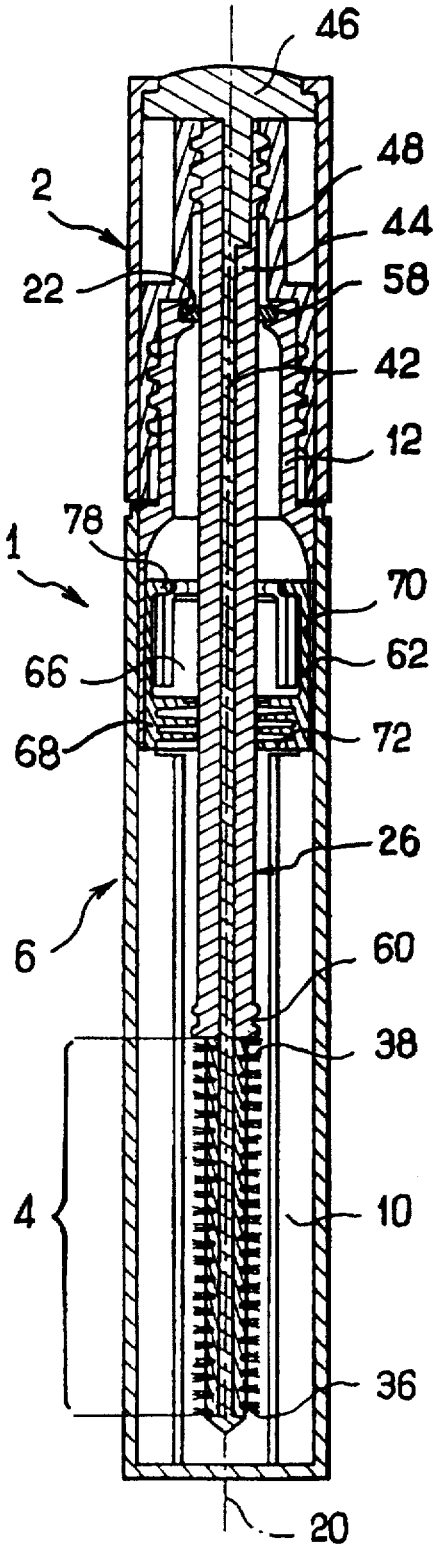
FIG. 1 is a diagrammatic view, in longitudinal median section, of the assembly according to the invention.
Figure 2:
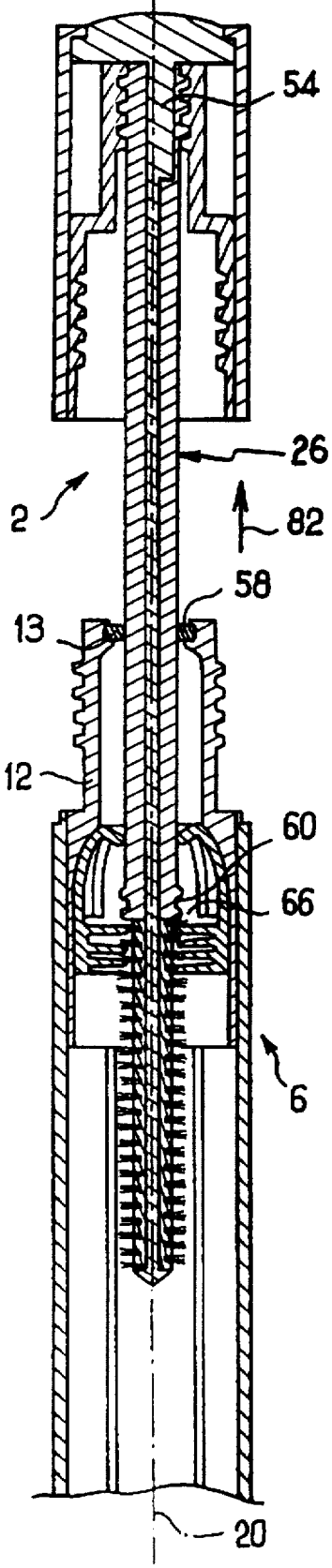
FIGS. 2 and 3 show, in partial longitudinal section, two successive stages of the withdrawal of the applicator from the body.
Figure 3:
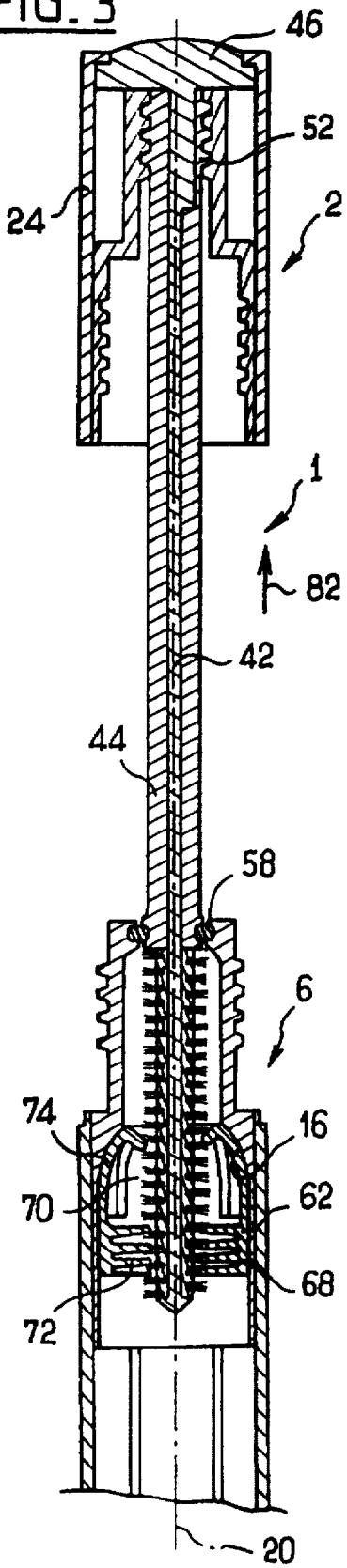

Referring first of all to FIGS. 1 to 3, it can be seen that the device 1 according to the invention has an axis 20 and comprises an applicator 2 carrying an application structure 4 for applying mascara which is accommodated, in the closed position of the assembly, in a body 6.

The body 6, which can be separated from the applicator 2, is hollow to define an internal mascara reservoir 10 having a hollow neck 12 at one end. This neck 12 comprises towards its opening a housing 22 defined by a peripheral internal groove partially delimited by an abutment shoulder 13.

The applicator 2 comprises a rectilinear axial rod 26 which carries the application structure 4 at one end and is equipped at the other end with a handle 24, which is in this case hollow, forming the cap of the body 6.

The structure 4 comprises adjacent substantially radial application surfaces 28 for charging and applying the mascara, here with combing of the lashes, and at least one resiliently deformable axial tubular block 30 which is connected to or associated with the surfaces 28 for the adaptation of a relative axial spacing of the surfaces from one another.

In the case in question, these surfaces 28, which are distributed along the rod substantially transversely to the axis 20, belong to a helical structure 40 carrying synthetic bristles 32. This helical structure 40, which is filamentary, here comprises at least one thread, preferably a metallic thread, which is flexible and fine (a few tenths of a millimetre in diameter) and which is wound on itself to form one or more twists where the bristles are locked. The twist is arranged tightly, in the manner of a helix, around the tubular block 30 which to some extent here constitutes its support and enables it to be adjusted, since the helical structure 40 thus formed may have (practically) no spring capacity.

Figure 5:
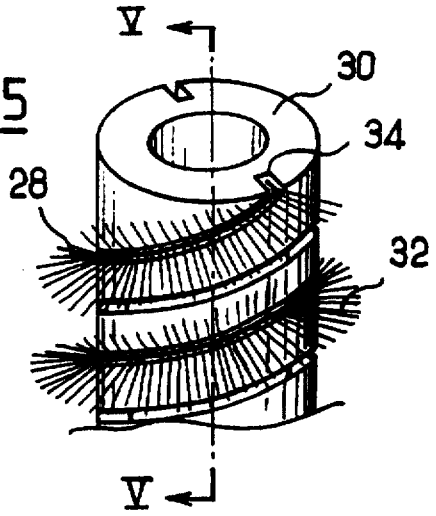
FIG. 5 is a detail view of the application structure.
Figure 6:
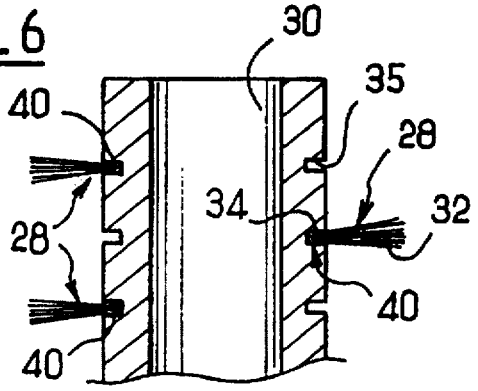
FIG. 6 is a sectional view along V—V of FIG. 5.

As illustrated in FIGS. 5 and 6, the block 30 (for example produced from an elastomer having a rubber-like consistency or from another synthetic rubber) also has on its (circular) external surface a continuous helical groove 34, of axis 20, which is capable of receiving the helical structure 40 tightly. The tubular block 30 can participate in the charging with product and in its application and, for that purpose, may comprise peripherally open cavities 35 for charging with mascara. These cavities here comprise a continuous helical groove which is axially offset relative to the groove 34. The tubular block 30 may also exhibit a roughness and/or porosity adapted so that it can retain mascara on its external surface (even outside its grooves 34 and 35).

Especially if the helical structure 40 does not have a spring quality, it has been found to be preferable to act on it, in order to adjust its pitch, by way of the block 30 to which it is connected. This is not, however, compulsory (if direct action is envisaged, the block 30 acts substantially as a "damper" especially at the passage of the drier 62).

Be that as it may, in order to ensure the adjustment of the pitch, it has been provided here that the rod 26 be in two coaxial parts, namely a hollow external rod 44 mounted to slide freely about an internal rod 42. The part 42 extends as far as into the handle 24, to one end of which it is secured via a securing head 46 which is accessible from the outside and which rotates freely without translation relative to the handle. The parts 42, 44 are rotationally secured thanks to locking means, such as an axial tongue 54 and its complementary slot 56.

The tubular block 30 is mounted around the part 42 having a smaller cross-section, with its first end 36 here fixedly connected to the part 42 (towards its free end 42*a*), the second end 38 being supported against the shoulder formed by the bulging free end 44*a* of the part 44.

The manoeuvring means acting on the member 30 to adjust the spacing of the surfaces 28 comprise, in addition to the rod 26, a member 48 for the relative sliding of the parts 42 and 44. This control member 48, which is stationary relative to the handle 24 to which it is secured, is in this case provided with a first tapped thread for screwing the applicator onto the body and with a second internal tapped thread 50 which is capable of cooperating with a thread 52 of the external rod 44.

Thus, any rotation of the handle relative to the fixed head 46 causes displacement (without rotation) along the axis 20 of the external rod 44. Depending on the sense of rotation, either the ends 42*a* and 44*a* of the two parts of the rod will be moved closer to one another, by exerting an axial constraint on the tubular block 30 (the length of which will be reduced), or these ends will be moved apart, by freeing the tubular block 30 of the constraint, its length then increasing. (It would also be possible to provide for direct action on a helical structure 40 of spring quality.)

FIGS. 1 to 3 illustrate the tubular block 30 under minimum constraint. The axial spacing between the surfaces 28 is then at a maximum and the groove 35 is wide and shallow for a major application of mascara.

Figure 4:
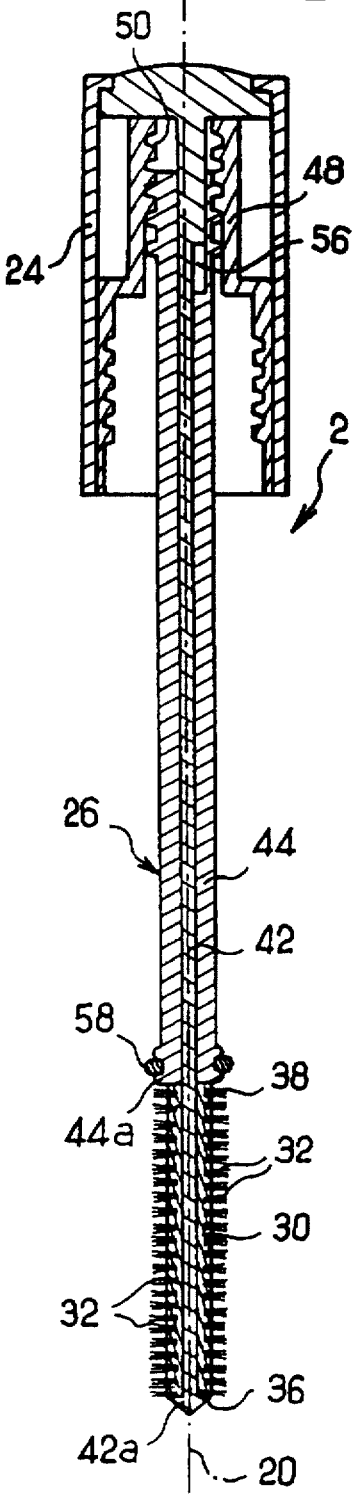
FIG. 4 is a view of the applicator only.

FIG. 4, on the other hand, shows the same applicator with its member 30 axially compressed. The surfaces 28 are then closer to one another and the groove 35 is narrower and deeper. In practice, this variation in length may be from a few millimetres to a few tens of millimetres.

The assembly 1 additionally comprises product-retaining means in order to remove any surplus mascara from the applicator. These means are first of all means 58 for cleaning the rod 26 which are slidably mounted relatively tightly along the rod to which they are permanently connected.

In the case in question, the means 58 comprise a flexible discoidal ring produced, for example, from an elastomer, which surrounds the external rod 44 while being able to engage in a removable manner in the housing 22 of the body 6 (where it then ensures that the body is sealed). On the applicator 2 side, the sliding of the ring is stopped by a groove 60 formed between two beads around the external rod 44, preferably in the immediate vicinity of the structure 4.

In addition to this ring, a movable "drying" and cleaning device 62 has also been provided inside the body 6, at the upper portion of the reservoir 10, which movable device has internally, at the mouth end, a narrowed portion 16.

The flexible device 62 has an internal axial passage 66 traversable by the applicator 2 in a fairly tightly sliding manner and in this case comprises two portions which are each capable of cleaning the rod and drying the application structure 4, namely a first portion 68 of fixed cross-section surmounted by a second portion 70 of variable cross-section. The cylindrical portion 68 here comprises deformable radial tongues 72, arranged transversely to the axis 20. With regard to the portion 70, which is also cylindrical, it is axially slotted to define several deformable tabs 74 which are naturally extended substantially parallel to the axis 20 and are each provided with an internal bead 78 for scraping the rod and drying the structure 4 further. The areas 72 and 78 of contact with the applicator are spaced apart from one another axially.

Advantageously, the device 62 is mounted to be axially movable in the reservoir 10 at the level of its narrowed portion 16, between a first, non-constrained state (lower position in FIG. 1) where the tabs 74 extend parallel to the axis 20, at a distance from the applicator, and a second, constrained state (upper position, FIGS. 2 and 3) where the portion 70 is arranged in the narrowed portion 16, the lengthening pieces 74 extending obliquely in the direction of the axis 20 until they abut the applicator of which the hollow external rod 44 and the structure 4 here have substantially the same outside diameter.

Figure 7:
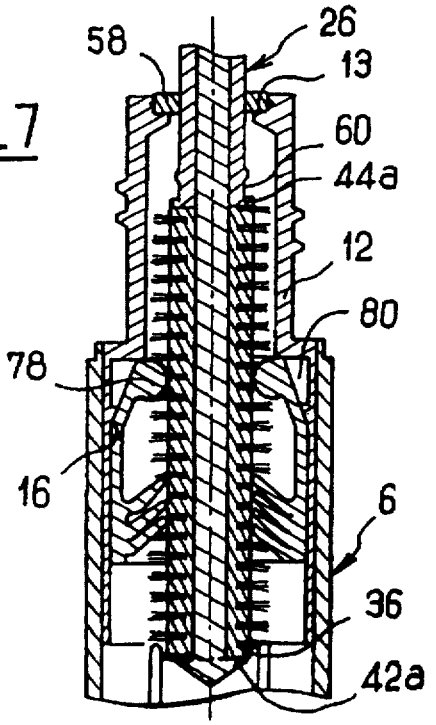
FIG. 7 is a partial longitudinal sectional view of a variant of the assembly.

FIG. 7 illustrates a variant of the assembly in which the structure 4 has an outside diameter greater than that of the external rod 44. In the upper position of the device 62, the ends of the tabs 74 are arranged in an area 80 of the body having an enlarged internal cross-section relative to the narrowed portion 16. They can move radially away from the axis 20 when they come into contact with the structure 4, after wiping the external rod 44.

The assembly 1 operates in the following manner: in the closed position of the assembly, the structure 4 and a portion of the rod are immersed in the mascara; the ring 58 is locked in its housing 22 and the device 62 is in its lower position, above the level of the mascara, the tongues 72 being in contact with the external rod 44. When the cap 24 has been unscrewed, the applicator is withdrawn from the body (arrow 82). In addition to drying of the application surfaces, triple cleaning of the external rod 44 is then ensured, respectively by the parts 68, 70 of the device 62 and by the ring 58, until the ring, having reached the level of the groove 60, becomes separated from the body 6, being entrained by the applicator. It will be noted that the drier 62 rises gradually as the applicator is withdrawn, until it reaches its radially constrained position shown in FIGS. 2 and 3.

When the structure 4 is no longer in contact with the device 62, the latter can move down again by itself or can be returned to its lower position by the applicator when it is reintroduced into the body, returning the ring 58 to its housing 22 as it passes.

The invention is of course in no way limited to the embodiments described: the application structure 4 could comprise several tubular blocks 30 aligned along the axis 20, and separated by metal or plastics interposed members (for example washers mounted on the internal rod 42), defining the application surfaces and carrying bristles.

Figure 8:
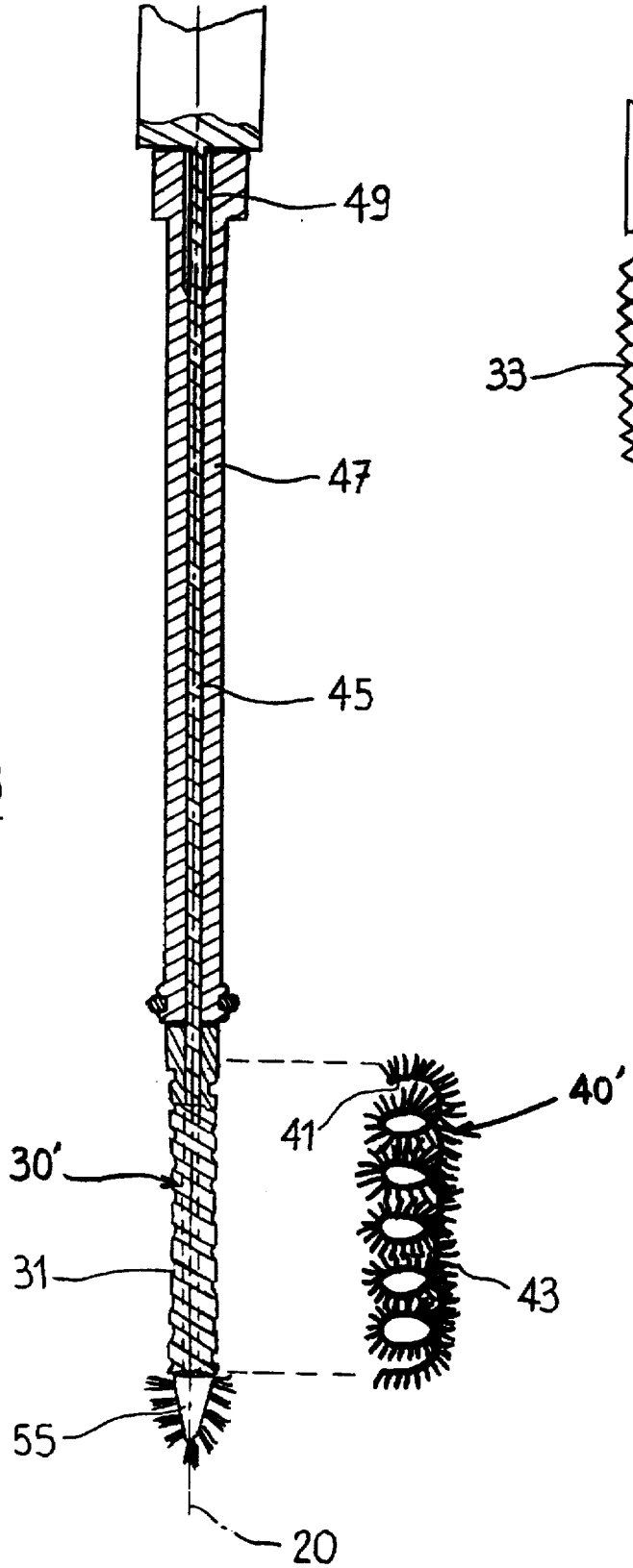
FIG. 8 is a partially external view, partially in longitudinal section, of another variant.

In the variant of FIG. 8, where the two members for supporting the adjacent application surfaces, 40', and for adjusting their axial spacing, 30', have been shown next to one another, these two members are produced from plastics "spring effect" material, such as polyacetal (POM).

The member 40' comprises a twisted metallic thread 41 without a spring capacity which can optionally retain bristles 43 between its twists, the thread being wound in the shape of a helix. The helix thus formed is to engage in the helical groove 31 of the tubular member 30', one end of which is applied against a bulging portion 55 formed at the free end of the rod 45. It will be noted that the shape of the bulging portion 55 is conical and that it carries bristles. It will also be noted that the two concentric rods 45, 47 have, at the end opposite the application area, a thread and a complementary tapped thread, respectively, which are generally indicated 49 and ensure their relative displacement along the axis 20 by relative rotation.

Figure 9:
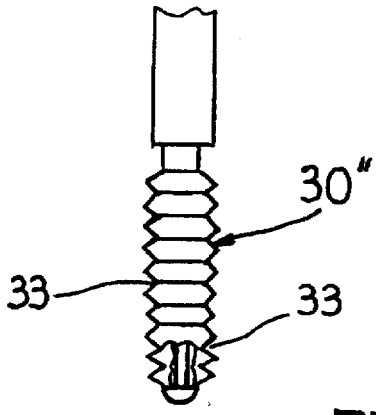
FIG. 9 illustrates another embodiment of the resilient adjusting member.

With reference to FIG. 9, it will be appreciated that it would be possible to replace the member 30' having a peripheral helix by a bellows member 30" which is resiliently deformable axially in accordance with the same principle as above, it then being possible for the other member (not shown) for supporting the application surfaces to be formed by a series of rings optionally provided with bristles and arranged in the hollows or radial grooves 33 of the bellows.

We claim:

1. Applicator for a cosmetic product, the applicator having an axis and comprising:

at least one axial rod;

a structure for the application of the product, which structure is carried by the rod and comprises adjacent surfaces for the application of the product;

manoeuvring means for adjusting the axial spacing between the application surfaces in order to optimise the action of the applicator and the amount of product to be applied, wherein the application structure also comprises:

at least one first member defining the surfaces for applying the product and, connected thereto, at least one second, resiliently deformable member for adjusting the axial spacing of the surfaces from one another, under the action of the manoeuvring means.

2. Applicator according to claim 1, characterised in that:

the first member comprises a filamentary structure to which bristles for the application of the product are attached; and the second member comprises a tubular block which is resiliently deformable axially and on which the filamentary structure is arranged; and the rod comprises two parts which are movable with respect to one another and are formed by a first axial rod, about a first portion of which is arranged a second, hollow, axial rod and about a second portion of which is arranged the resiliently deformable tube which is interposed and retained for its axial adjustment between the second, hollow, rod and a bulging portion arranged at a free end of the first rod.

3. Applicator according to claim 2, characterised in that the tubular block comprises at least one peripheral groove in which the filamentary structure is arranged, for its axial adjustment.

4. Applicator according to claim 1, characterised in that the first member is substantially devoid of spring capacity.

5. Applicator according to claim 3, characterised in that the second, adjusting member also comprises open peripheral cavities for charging with product.

6. Applicator according to any one of claim 3, characterised in that the peripheral groove of the tubular block is in the shape of a helix.

7. Assembly for the storage and application of a cosmetic product, this assembly having an axis and comprising:

a body provided with an opening and including a reservoir capable of containing the product;

an applicator capable of coming into contact with the product and of being charged therewith, this applicator comprising:

at least one rod;

a structure for the application of the product, which structure is carried by the rod and comprises adjacent surfaces for the application of the product;

manoeuvring means for adjusting the axial spacing between the application surfaces in order to optimise the action of the applicator and the amount of product to be applied; and product-retaining means, which are connected to the body and/or to the rod, for ridding the applicator of excess product, wherein the application structure comprises:

at least one first member defining the surfaces for applying the product and, connected thereto;

at least one second, resiliently deformable member for adjusting the axial spacing of the surfaces from one another, under the action of the manoeuvring means.

8. Assembly according to claim 7, characterised in that the retaining means comprise a define for drying the application structure and for cleaning the rod, the device being arranged and retained inside the body and comprising a first and a second portion for retaining the product, which portions are spaced axially from one another, and having an internal passage capable of receiving the applicator in a sliding manner.

9. Assembly according to claim 8, characterised in that the device for drying and cleaning is mounted to be axially slidable in the body and has a cross-section which can be varied between a first state where the second portion of the device is at a radial distance from the applicator and a second state where the second portion is locally in contact with the applicator, under the effect of a narrowed portion of the internal cross-section of the body.

10. Assembly according to claim 9, characterised in that the second portion of the drying and cleaning device comprises resiliently deformable tabs which extend substantially parallel to the axis of the assembly, in the first state, and are inclined relative to that axis, in the second state, with radial play for adaptation to the diameters of the rod and of the application structure.

11. Applicator according to claim 2, characterised in that the first member is substantially devoid of spring capacity.

12. Applicator according to claim 3, characterised in that the first member is substantially devoid of spring capacity.

13. Applicator according to claim 4, characterised in that the second, adjusting member also comprises open peripheral cavities for charging with product.

14. Applicator according to claim 11, characterised in that the second, adjusting member also comprises open peripheral cavities for charging with product.

15. Applicator according to claim 12, characterised in that the second, adjusting member also comprises open peripheral cavities for charging with product.

16. Applicator according to claim 4, characterised in that the peripheral groove of the tube is in the shape of a helix.

17. Applicator according to claim 11, characterised in that the peripheral groove of the tube is in the shape of a helix.

18. Applicator according to claim 12, characterised in that the peripheral groove of the tube is in the shape of a helix.

19. Applicator according to claim 5, characterised in that the peripheral groove of the tube is in the shape of a helix.

20. Applicator according to claim 13, characterised in that the peripheral groove of the tube is in the shape of a helix.

21. Applicator according to claim 14, characterised in that the peripheral groove of the tube is in the shape of a helix.

22. Applicator according to claim 15, characterised in that the peripheral groove of the tube is in the shape of a helix.

* * * * *